US006680446B1

(12) United States Patent
Saxer et al.

(10) Patent No.: US 6,680,446 B1
(45) Date of Patent: Jan. 20, 2004

(54) SAFETY SWITCH DEVICE FOR CONTROLLING A MACHINE IN RELATION TO THE POSITION OF MONITORED DEVICE

(75) Inventors: Stefan Saxer, Sargans (CH); Michael Euchner, Leinfelden-Echterdingen (DE); Gerhard Prirsch, Leinfelden-Echterdingen (DE)

(73) Assignee: Euchner GmbH & Co., Leinfelden-Echterdingen (DE)

( * ) Notice: Subject to any disclaimer, the term of this patent is extended or adjusted under 35 U.S.C. 154(b) by 0 days.

(21) Appl. No.: 09/856,568

(22) PCT Filed: Apr. 1, 2000

(86) PCT No.: PCT/EP00/02933

§ 371 (c)(1),
(2), (4) Date: May 23, 2001

(87) PCT Pub. No.: WO00/63934

PCT Pub. Date: Oct. 26, 2000

(30) Foreign Application Priority Data

Apr. 16, 1999 (DE) ..... 199 17 211

(51) Int. Cl.[7] ..... H01H 3/16
(52) U.S. Cl. ..... 200/61.71
(58) Field of Search ..... 200/43.14, 43.15, 200/43.16, 43.19, 43.21, 43.04, 43.05, 43.07, 61.72, 61.71, 61.73; 70/DIG. 30; 235/449

(56) References Cited

U.S. PATENT DOCUMENTS

| | | | | | |
|---|---|---|---|---|---|
| 508,680 | A | * | 11/1893 | Chase | 200/61.71 |
| 1,123,758 | A | * | 1/1915 | Knoblock | |
| 2,813,938 | A | * | 11/1957 | Speizman | |
| 5,079,390 | A | * | 1/1992 | Costanzo et al. | 200/43.14 |
| 5,350,894 | A | * | 9/1994 | Allison | 200/61.71 |
| 5,760,353 | A | | 6/1998 | Rapp | 200/43.04 |
| 6,084,185 | A | | 7/2000 | Bachle | 200/43.07 |
| 6,166,340 | A | * | 12/2000 | Hormann | 200/61.71 |
| 6,409,083 | B1 | | 6/2002 | Link | 235/449 |

FOREIGN PATENT DOCUMENTS

| | | |
|---|---|---|
| DE | 43 28 297 C1 | 2/1995 |
| DE | 43 32 500 | 3/1995 |
| DE | 196 49 717 A1 | 6/1998 |
| DE | 197 11 588 A1 | 9/1998 |

* cited by examiner

*Primary Examiner*—Neil Abrams
(74) *Attorney, Agent, or Firm*—Smith, Gambrell & Russell, LLP

(57) ABSTRACT

A safety switch (1, 101) for switching a connection in relation to the status of a device to be monitored. The safety switch (1, 101) utilizes an actuator (2, 102) that that can be inserted into the safety switch (1, 101) from a first side (6, 106) and can be withdrawn from a second side (30, 130). The actuator (2, 102) forms a releasable locking engagement with an actuator receptacle (8, 108) located inside the safety switch (1, 101) to form a signal transfer (14,16). The safety switch (1, 101) also can have an ejector that removes the actuator from the actuator receptacle (8, 108).

19 Claims, 2 Drawing Sheets

SAFETY SWITCH DEVICE FOR CONTROLLING A MACHINE IN RELATION TO THE POSITION OF MONITORED DEVICE

The invention pertains to a device for switching a connection, especially an electrical connection in relation to the status of a device to be monitored, especially a safety switch, according to the preamble of claim 1.

Such devices are known, for example, from DE43 28 297 C1. This device has, in a lower housing part, switching means for switching an electrical connection, and in a head part, an opening for inserting the actuator. The actuator turns a switching disk on its rotary axis oriented at a right angle to the insertion direction. Atop the jacket surface of the switching disk is a switching plunger that actuates the switching means and therefore the electrical connection, and which can be held by means of an electromagnet in a position blocking the switching disk and therefore the actuator.

Known from DE43 32 500 A1 is a locking device for monitoring movable protective mechanisms, with two position switches located in the housing and working independently of each other, which can be actuated by means of a switching strip with depressions that passes into and through a housing head.

A safety switch is known from DE196 49 717 A1, the head part of which has two insertion openings, which together determine for the actuator two insertion directions set at a right angle to each other. Depending upon which insertion opening the actuator is inserted into, the switching disk turns in one or the opposite direction. By appropriate means, the switching disk can be fixed in either its starting position or with completely inserted actuator.

Known from DE197 11 588 A1 is a safety switch in which both the actuator and the device have a signal means, by which a contact-free signal transfer can be carried out, which optionally leads to a switching of the electrical connection. The locking of the actuator in the device is accomplished by an engagement by means of magnetic force of an axially displaceable plunger in an opening of the actuator. To determine whether the actuator is inserted and properly locked, both the position of the actuator in the device and the position of the locking plunger must be scanned and linked with a logical AND function.

In the known devices, the actuator must be withdrawn from the device from the same side from where it had been inserted into the device. This results in problems, especially in the monitoring of protective devices of modern machine tools or processing centers with directionally displaceable and partially surrounding sliding windows or sliding doors. These disadvantages are even more significant when, in addition, a locking of the safety device and a monitoring of the lock are required.

It follows that the problem fundamental to the present invention is to make available a device that is universally usable with a multitude of safety devices to be monitored and makes possible a monitorable locking of the device at minimum cost.

The problem is resolved by the device disclosed in claim 1. Special embodiment forms of the invention are disclosed in the subordinate claims.

Due to the fact that the actuator can be withdrawn from the device on a second side, actuators that can be passed through the device are realizable, which, For example, are displaceable in two directions or can be mounted on encircling safety devices. It should be understood that under the first and second sides of the device, there are different, preferably planar, areas delimiting the device. Normally, the device has a housing, which holds the switching element that switches the preferably electrical connection. Via an opening in the housing, the actuator can be inserted or withdrawn. To the extent that the device encompasses a switching disk, the latter is linked to the device or its housing so as to be rotatable by the actuator. The switching disk can then be rotated in both directions, depending upon from which side the actuator is inserted. Both rotary directions can then lead to a switching operation. The head part with the opening(s) for the actuator can be removable from the rest of the housing of the device. Preferably, the head part is open on three sides, while the actuator can be inserted from a first side and can be withdrawn on a second side opposite the first side. Via a third side joining the first and the second sides, the actuator can be secured on the device to be monitored. In this embodiment the head part has a U-shaped cross section. The actuator can also be withdrawn from the device on the third side or be inserted on the third side. The device can also be secured on the device to be monitored, for example, a sliding door or a protective hood, which in this instance is movably affixed in relation to the immovable actuator, for example, on the frame of the device.

Due to the fact that the actuator can be passed through the device, a device designed in this manner can be used in almost all applications, especially for encircling protective devices. Although possible, it is specifically not necessary to withdraw the actuator on the side of the device where it had been inserted into the device.

Since the actuator can be fixed in the device, especially at least partially fixed in form-fit fashion and/or locked, the closed status, For example, of the device to be monitored is arrestable until a machine tool covered by the device has come to a standstill. The release of the locking can ensue manually or automatically once the machine is at a standstill.

Due to the fact that the device includes an actuator receptacle, which can be brought into releasable locking engagement with the actuator, the locking can necessarily take place with each insertion of the actuator. The actuator receptacle and the actuator are especially so designed that they can at least partially be form-fitted together. The locking ensues specifically due to a movement of the actuator transverse to the insertion direction, preferably at an angle of 90°. As a result, a secure locking effect can be achieved even with weak locking forces. To this end, the actuator is movably linked on the device or the mechanism, especially pivotably linked. Alternatively or supplementally thereto, the actuator receptacle or parts thereof can also be movably designed. Since the weight of the actuator reinforces the locking engagement and preferably effects the locking engagement, additional driving means for the locking movement can be dispensed with. Worthy of consideration as alternative or augmentation is the use of a force accumulator, For example, a compression spring, an electromagnetic drive or a pneumatic propulsion of the actuator, in order to force the actuator into locking engagement and/or to retain the locking engagement.

Inasmuch as the actuator receptacle forms a ramp-like approach surface for the actuator, elevation of the actuator for the subsequent locking engagement in the actuator receptacle can be accomplished without supplemental driving means. A linear or spherical ramp facilitates high processing speeds of the actuator or the protective device with simultaneous secure engagement or locking of the actuator in the actuator receptacle. The ramp is oriented toward all sides, from which the actuator can be inserted into or removed from the device.

By virtue of the fact that the actuator receptacle has a rotatably, and especially a pivotably linked locking element, which can be swung out when the actuator is inserted, it is possible for the actuator to be secured essentially immovably, for example, on the device to be monitored. For instance, the actuator receptacle forms a ramp-like locking element, which, when the actuator is inserted, swings out in such a way that the way is cleared for the actuator to reach the position of locking engagement with the actuator receptacle. As soon as this position is reached by the actuator, the locking element forms a locking surface for the actuator, for example, by pivoting back into its starting position. For loosening the locking engagement, the locking element is again rendered pivotable in such a way that the actuator can be drawn back out of the device.

Since the actuator and the actuator receptacle have signal means working together without contact, additional, especially movable parts inside the device, which serve, for example, to transfer the movement of actuator to a switching plunger, can be dispensed with. Of course, the electrical connection to be switched can still be contact-switched, for example, by means of a relay addressed by the signal means. The preferably electronic signal means also permits by way of an appropriate coding a clear identification of the actuator. The signal transfer is not contact burdened and takes place especially wirelessly, for example, optically or by radio. The paired signal means can be configured in various ways.

For example, only one of the two signal means, preferably that secured on the device, can send out a signal or information, and the other signal means provides essentially a complete or partial reflection of the emitted signal. Alternatively, the other signal means can receive the emitted signal and send it back to a signal means unchanged or individually altered. Here analog and/or digital signals can be transmitted in one or both directions. Preferably, one of the signal means, especially that secured on the device, also provides the power for the operation of the other signal means, preferably in the form of electromagnetic radiation in the visible or invisible frequency range.

Inasmuch as a signal transfer is only possible when the actuator is irremovably locked in the device, i.e., when the actuator and the actuator receptacle are in locked engagement, an additional locking of the actuator and especially an additional query of the position of the locking plunger, as well as the AND function with the query of the position of the actuator, can be dispensed with. In the locking engagement of the actuator and the actuator receptacle, the first and the second signal means are directly opposite each other. In particular, they can be located on opposing locking surfaces. Preferably, the second signal means located in the actuator receptacle is so arranged and set back from the surface of the actuator receptacle facing the actuator that the electromagnetic radiation emitted by it has a directional characteristic toward the position of the first signal means of the actuator in the status of the locking engagement. Security against an erroneous closure is thereby ensured, i.e., a signal transfer between the two signal means is precluded, despite the fact that the actuator is still not in locking engagement with the actuator receptacle.

By virtue of the fact that the device can be operated only with the provided actuator for switching the connection, a manipulation safety is ensured for the device. This can take place especially because the device has a narrow and/or deep slit for guiding the actuator through, which makes the actuator receptacle inaccessible from the outside at least to the extent that the device cannot be made to switch with a means not provided for switching said means and/or that the actuator in engagement with the actuator receptacle is releasable from this engagement. This is realizable, for example, with a flat slit open on three sides and U-shaped in cross section, through which the actuator can be guided from a first to the oppositely located side. The manipulation safety is enhanced by the use of first and second signal means, which makes possible a clear identification of the actuator, For example, by means of a code word stored in the first signal means of the actuator, and switches the connection only with commensurate identification.

Insofar as the device for loosening the locking of the actuator encompasses unlocking means, the unlocking can occur automatically. Especially acceptable are electromagnetic or pneumatically driven ejectors, a force accumulator in the form of a spring or a compressed-air nozzle, depending upon whether the locking of the actuator in the actuator receptacle is accomplished by spring force or magnetic force or simply by gravity.

Further advantages, characteristics and details of the invention are disclosed in the subordinate claims and in the following description, in which several embodiment examples are described in detail with reference to the appended drawings. In this connection, each of the characteristics mentioned in the claims and in the description can be material to the invention individually or in any combination.

Figure 1:
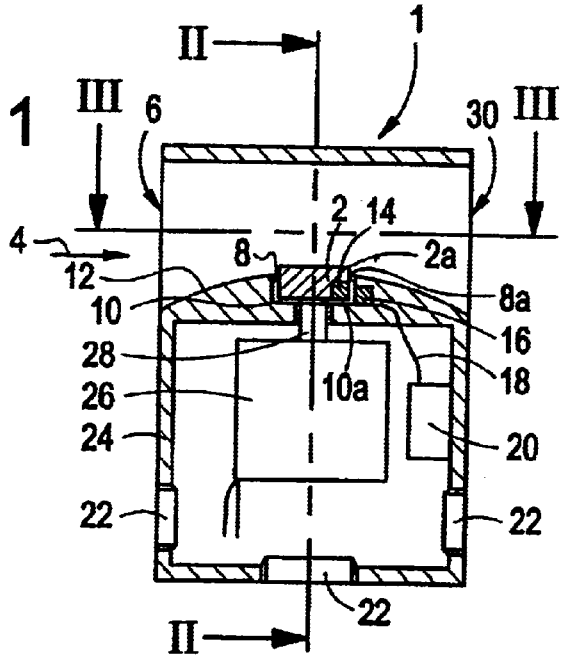
FIG. 1 depicts a cutaway front view of a device according to the invention.
Figure 2:
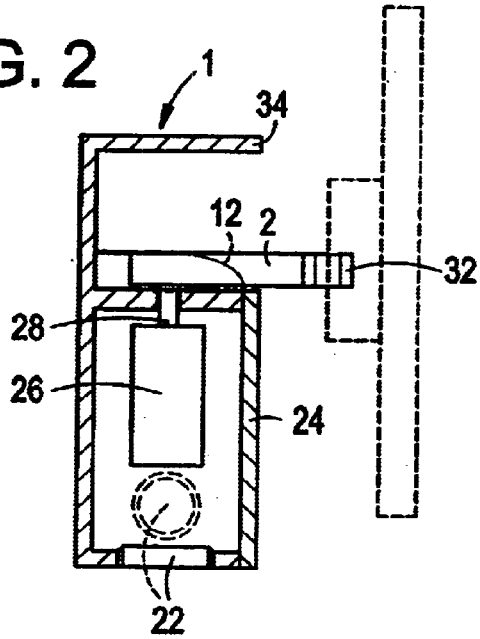
FIG. 2 depicts a section II—II through the device in FIG. 1.
Figure 2A:
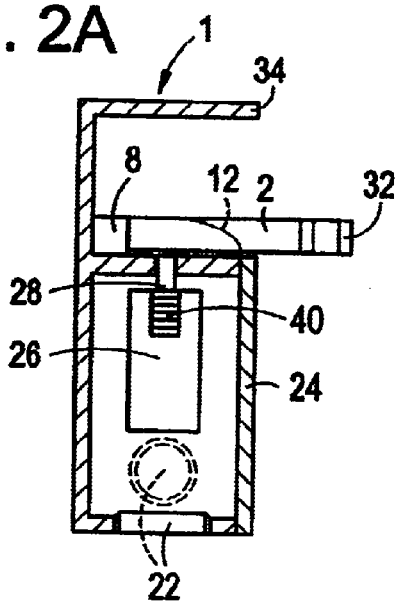
Figure 3:
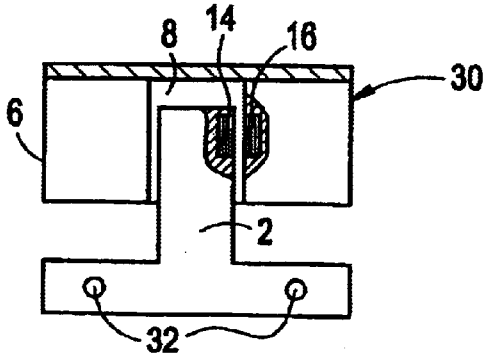
Figure 4:
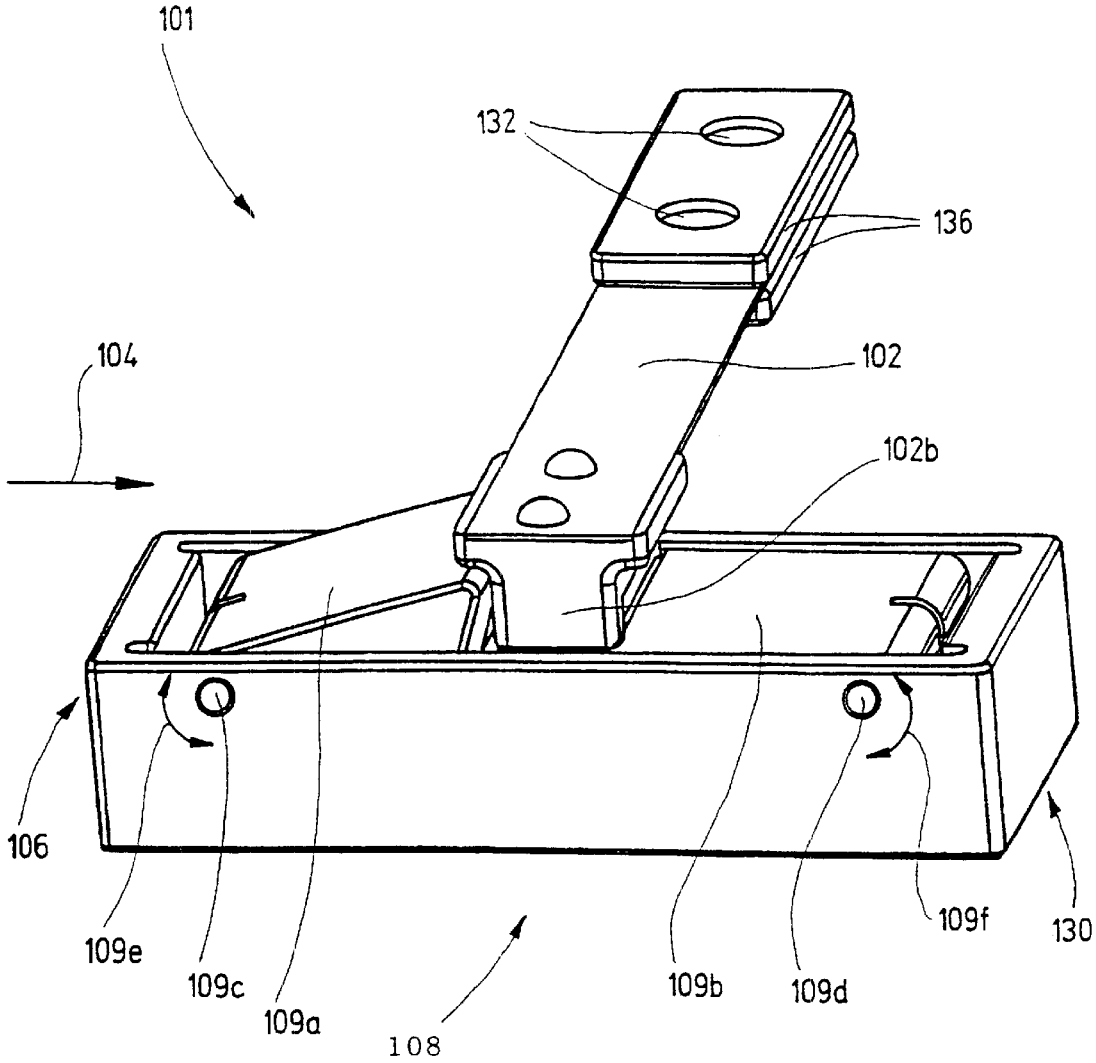

FIG. 2*a* depicts an alternative section II—II through the device in FIG. 1, FIG. 3 depicts a section III—III through the device in FIG. 1, and FIG. 4 depicts a perspective view of a second embodiment example.

FIG. 1 depicts a cutaway front view of a device according to the invention. In the interest of better illustration, the mechanism to be monitored is not shown. The actuator (2) is inserted in the direction indicated by the arrow (4) into the device (1) from the first side (6) and into engagement in the illustrated position with the actuator receptacle (8), which forms a slit (10), the width of which essentially corresponds to that of the actuator (2) and is especially slightly greater. The actuator (2) was therein elevated against the force of its own weight during the insertion movement by the spherical, and in the depicted section, partially curved ramp (12) formed by the actuator receptacle (8) and has assumed the depicted position of the locking engagement by falling into the slit (10). The fit between the slit (10) and the actuator (2) is here shown in enlargement for reasons of illustrative clarity. The actuator (2) has, on its side facing the delimiting surface (8*a*) of the actuator receptacle (8), a first signal means (14), which can execute a contact-free signal transfer with a second signal means (16) located on a side of the actuator receptacle (8) facing the delimiting surface (2*a*) of the actuator (2). Here the second signal means (16) is set back opposite the delimiting surface (8*a*) of the actuator receptacle (8), wherein, due to the masking effect of the actuator receptacle (8), which is preferably metal, at least in this area, a directional characteristic for the signal emitted by the second signal means (16) results, in such a way that a signal transfer is possible only when the actuator (2) is in locking engagement with the actuator receptacle (8) and especially the first signal means (14) is directly opposite the second signal means (16).

Via the signal line (18) the signal means (16) is connected to the switching and operating means (20), which, for example, includes an electronic switching element or a relay for switching the electrical connection as a function of the status of the device to be monitored or the position of the actuator (2). Suitable for this purpose are all switching means known from the state of the art. In a comparable manner, optical, pneumatic or hydraulic connections can also be switched. The passages (22) in the housing (24) are provided for the (not shown) connecting lines and supply lines.

An electronically actuated ejector serving as an unlocking means for freeing the actuator (2) includes a magnetic coil or an air ejector (26) that, when activated, moves the armature (28) toward the actuator (2) and elevates the latter sufficiently for it to disengage from the actuator receptacle (8). In this position the actuator (2) is also able to continue to move in the direction indicated by the arrow (4) and exit the device (1) on the second side (30). In a comparable manner, the actuator (2) can also be inserted into the device (1) on the second side (30) and withdrawn on the opposite side (6).

The receiving surface formed by the actuator receptacle (8), which in FIG. 1 is represented by the slit (10), can be so designed in respect to its dimensions in relation to the actuator (2) that, at every speed of the insertion of the actuator (2) into the device (1) realizable in actual practice and in consideration of the inertia of the masses involved, locking engagement of the actuator (2) in the actuator receptacle (8) takes place, or only when the speed during the insertion of the actuator (2) remains below a certain value. In the first case cited, the engagement of the actuator (2) in the actuator receptacle (8) can be prevented when the unlocking means (26, 28) is activated at the comparable point in time, i.e., when the armature (28) assumes its withdrawn) position. Certain machine controlled positions for the mechanism to be monitored can be locked thereby, in any event there can be no locking engagement between the actuator (2) and the actuator receptacle (8) in these positions as long as the unlocking means (26, 28) is activated.

In the illustrated embodiment example, the actuator (2) assumes the position of locking engagement with the actuator receptacle (8) solely due to the force of its weight. Alternatively or supplementally thereto, the actuator (2) can be maneuvered into or held in this position, for example, by means of magnetic or spring force. For example, especially suitable for retaining the actuator (2) in the position shown in FIG. 1 is the magnetic coil (26) with the armature (28) omitted. The unlocking could then occur following disengagement of the magnetic coil (26) by spring force or by a compressed air ejector. For unlocking the actuator (2), the actuator receptacle (8) could also be lowered until the actuator (2) is no longer in contact with the actuator receptacle (8). The assumption of the position of locking engagement of the actuator (2) in the actuator receptacle (8) can also be secured by other means, such as a permanent magnet mounted on the actuator (2) and working together with the actuator receptacle (8) or a spring-action locking sphere provided on the actuator receptacle (8) and working together with a molding on the actuator (2).

The housing (24) can be designed with funnel-like guides on the insertion sides (6, 30), which facilitate the insertion of the actuator even with inexactly closing devices.

FIG. 2 depicts section II—II through the device in FIG. 1. The actuator (2) can be pivotably affixed on the device to be monitored by means of two fastening holes (32) arranged one behind the other and perpendicular to the plane of the drawing in FIG. 2 and associated connection means. The device to be monitored can be a sliding door that is part of a protective device of a machine tool. The ramp (12) formed by the actuator receptacle (8) is of spherical design on the front side and has an arc-like course in the cross section in FIG. 2. The housing (24) forms a collar (34) covering the actuator receptacle (8), the elevation of which above the actuator receptacle (8) as shown has been selected solely for the sake of clarity and in reality is selected only sufficiently large to ensure the manipulatiion safety of the device (1). FIG. 2*a* has a similar structure to the embodiment shown in FIG. 2, except for the addition of a spring (40) attached to the armature (28).

FIG. 3 depicts a section III—III through the device in FIG. 1. Here the areas around the first (14) and the second (16) signal means on the actuator (2) and the actuator receptacle (8) are shown in broken outline. In the position of the locking engagement of the actuator (2) and the actuator receptacle (8), the two signal means (14, 16) face each other. Fundamentally to be considered as well is the provision of the second signal means (16) on the base surface (10*a*) of the actuator receptacle (8) formed in the area of the slit (10) (FIG. 1).

FIG. 4 is a perspective view of a second embodiment example. For the sake of clarity, only the actuator (102) and the actuator receptacle (108) are shown. The actuator (102) can be essentially immovably affixed on the mechanism to be monitored by means of the fastening holes (132) and appropriate connection means along with compensation means (136). It bears on an end remote from the localization an essentially cubic actuator head (102*b*), which holds the first signal means (not shown). The actuator receptacle (108) has first and second locking elements (109*a*, 109*b*), which are respectively rotatable as indicated by the double arrow (109*e*, 109*f*) on axes (109*c*, 109*d*) running at right angles to the insertion direction (104) of the actuator (102). When the actuator (102) was inserted from the first side (106) in the direction of the arrow (104), the first locking element (109*a*) was swung out and had thereby freed the way for the actuator (102) to move into the position of the locking engagement with the two locking elements (109*a*, 109*b*). In the position of the locking engagement, the first and the second locking elements (109*a*, 109*b*), for example, under spring force, assume their original position. In which a signal transfer between the (not shown) signal means is not possible, the second signal means can be located both on the first and/or the second locking element (109*a*, 109*b*), as well as preferably on an immovable part of the actuator receptacle (108). In FIG. 4 the second locking element (109*b*) is shown in its unlocked position, in which the actuator (102) can be withdrawn from the device (101) via the second side (130).

What is claimed is:

1. A safety switch comprising:

a housing having a first side and a second side;

an actuator receptacle located inside the housing; and an ejector for freeing an actuator from the actuator receptacle;

wherein the actuator can enter the housing from the first side and exit the housing from the second side.

2. The safety switch according to claim 1, wherein the ejector comprises a magnetic coil and an armature that elevates the actuator when the magnetic coil is activated.

3. The safety switch according to claim 1, wherein the ejector comprises a spring.

4. The safety switch according to claim 1, wherein the ejector comprises a compressed air ejector.

5. The safety switch according to claim 1, wherein the actuator comprises a first signal means and the actuator receptable comprises a second signal means.

6. The safety switch according to claim 5, wherein the first signal means stores a code.

7. The safety switch according to claim 1, wherein the ejector comprises a magnet.

8. The safety switch according to claim 1, wherein withdrawal of the actuator from the safety switch is, in regard to movement direction, a continuation of insertion.

9. The safety switch according to claim 1, wherein the actuator can be releasably locked in the safety switch.

10. The safety switch according to claim 1, wherein the actuator and the actuator receptacle can be brought together in a releasable locking engagement.

11. The safety switch according to claim 10, wherein weight acting upon the actuator reinforces the releasable locking engagement.

12. The safety switch according to claim 1, wherein the actuator receptacle has a ramp.

13. The safety switch according to claim 1, wherein the actuator receptacle has at least one rotatably linked locking element, which can be pivoted when the actuator is inserted.

14. The safety switch according to claim 1, wherein the actuator has a first signal means and the actuator receptacle has a second signal means, between which a contact-free signal transfer can be carried out.

15. The safety switch according to claim 14, wherein the contact-free signal transfer is possible only when the actuator is in releasable locking engagement with the actuator receptacle.

16. The safety switch according to claim 1, wherein the actuator receptacle is arranged in the safety switch in such a way that switching of the connection is possible only with the actuator.

17. The safety switch according to claim 1, wherein the ejector comprises an unlocking means.

18. The safety switch according to claim 1, wherein the safety switch is securable on a device to be monitored.

19. The safety switch according to claim 12, wherein the ramp is linearly or spherically configured toward at least two sides.

* * * * *